US005897408A

United States Patent [19]

Goode

[11] Patent Number: 5,897,408

[45] Date of Patent: Apr. 27, 1999

[54] SLALOM WATER SKI BOOTS AND RELEASABLE BINDING

[76] Inventor: David P Goode, 1977 Long Lake Shore Dr., Bloomfield Hills, Mich. 48302

[21] Appl. No.: 08/914,544

[22] Filed: Aug. 19, 1997

[51] Int. Cl.[6] ..... B63B 35/85

[52] U.S. Cl. ..... 441/70; 280/611

[58] Field of Search ..... 441/65, 67, 68, 441/70, 74; 280/611, 617

[56] References Cited

U.S. PATENT DOCUMENTS 4,227,274 10/1980 Richardson ..... 441/68
4,645,466 2/1987 Ellis ..... 441/74

*Primary Examiner*—Jesus D. Sotelo
*Attorney, Agent, or Firm*—Young & Basile, P.C.

[57] ABSTRACT

A semi-rigid boot and releasable binding system for use on water skis. The semi-rigid boot provides lateral support to the ankle and lower leg of the water skier but allows the required flexibility in the fore/aft directions. The boots are non-releasably attached to the top surface of a plate. The bottom surface of the plate is provided with a hook and loop-type fastener surface. A mating surface of hook and loop-type fastener is attached to the upper surface of the ski. The plate is releasably secured to the water ski using the mating hook and loop-type fasteners on the bottom of the plate and the top of the water ski.

12 Claims, 3 Drawing Sheets

SLALOM WATER SKI BOOTS AND RELEASABLE BINDING

FIELD OF THE INVENTION

The present invention relates to boots and bindings for water skis.

DESCRIPTION OF THE PRIOR ART

Water skiing has been a popular sport for many years. Past and present water skis typically hold the skier's feet in position on the ski using soft, flexible, stirrup-type rubber boots built into the ski. Various modifications of flexible boots and bindings have been patented over the years. See U.S. Pat. No. 3,992,738 issued to Kiefer, U.S. Pat. No. 4,770,648 issued to Gillis, and U.S. Pat. No. 4,891,027 issued to Plunkett. When the skier falls, the flexible rubber boots yield to release the feet, thereby freeing the skier from the ski and reducing the chance of injury. Prior art rubber boots use different techniques for determining the force at which the skier's foot is released from the flexible boots, which remain on the ski.

These flexible rubber boots, however, provide neither adequate support for the user's feet and ankles nor optimal control over the ski. Control over the ski is critical while initially gaining momentum from the tow boat and while maneuvering on the water, especially during slalom-type competition.

A second drawback is the difficulty a water skier encounters while trying to replace his foot into the flexible boot. To obtain maximum control, the flexible boot should fit as snugly as possible, which generally means a lot of effort in forcing the foot into the boot.

U.S. Pat. No. 5,181,332 issued to Uren et al. offers a solution to the problem of inadequate leg support by providing a rigid water ski boot, and bindings similar to snow ski bindings. This design provides stability to the user's ankles and lower legs in the lateral direction, thus increasing the maneuverability of the water skier in the water by allowing the skier to withstand greater lateral forces while slalom skiing. The boot is designed to be flexible in the fore and aft direction to allow the water skier to crouch and maintain his balance during the critical initial pull by the towing boat. The bindings for each boot are releasable snow-ski types which release the boots during a fall.

U.S. Pat. No. 4,822,310 issued to Parker et al. discloses a flexible rubber boot secured to the ski in removable but non-releasable fashion. In one embodiment the removable boot is held in place on the ski with hook and loop fasteners; in another by a clamp arrangement with a compression screw. In both cases the boot or stirrup may be removed from and replaced on the ski for adjustment purposes, but the release mechanism for the skier's foot is via the soft, yielding nature of the boot or stirrup, which remains on the ski during a fall.

SUMMARY OF THE INVENTION

In general, the invention is a slalom-style water ski with semi-rigid boots held in place on the ski using a hook and loop fastener designed to release the boots from the ski at an appropriate force level during a fall.

The boots are non-releasably attached in fore and aft slalom-style to the top surface of a sole plate to form a boot/plate unit. The bottom surface of the plate is provided with a hook and loop type fastener surface. A mating surface of hook and loop-type fastener is attached to the upper surface of the ski. The boot/plate unit is releasably secured to the water ski using the mating hook and loop-type fastener on the bottom of the plate and the top of the water ski, securing the boot/plate unit to the ski during normal skiing and releasing only during a fall or when intentionally removed. The boots non-releasably hold the feet of the skier.

Further objects and advantages of my invention will become apparent from a consideration of the drawings and following description.

DETAILED DESCRIPTION OF THE DRAWINGS

Figure 1:
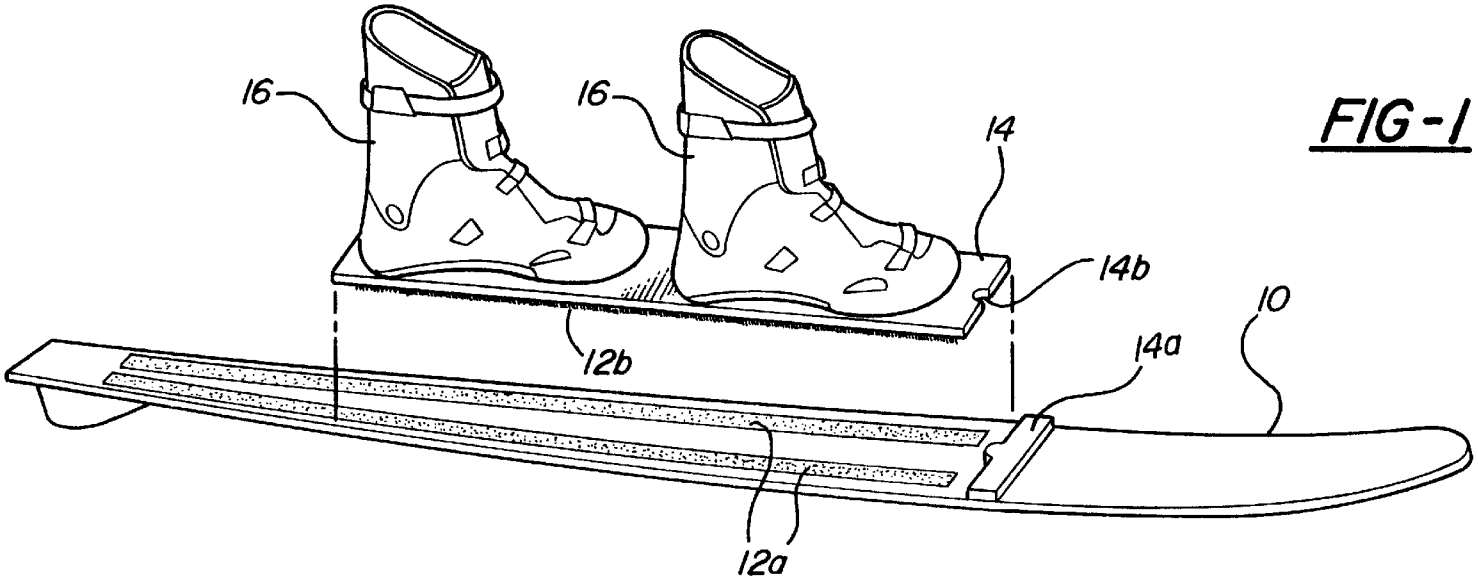
FIG. 1 is an exploded view of a preferred embodiment of a water ski, binding system, and boots according to the present invention.

Referring first to FIG. 1, a water ski 10 of known type is illustrated, and can comprise any known ski, although the high performance composite ski available from Goode Ski Technologies in Waterford, Mich. is preferred. The ski is initially manufactured without bindings, having a smooth upper surface 11. The binding system of the present invention comprises two primary components: one or more pieces or strips of hook and loop type fastener 12*a* secured to the upper surface 11 of ski 10; and one or more mating strips or pieces of hook and loop type fastener 12*b* secured to the bottom of a boot-supporting plate 14 to which a boot or boots are non-releasably attached, such that plate 14 forms a unifying sole plate for boots 16.

Hook and loop-type fastener 12 is commercially available, for example comprising Velcro® brand fastener or Dual-Lock® brand fastener material. Dual-Lock® fastener is preferred due to its higher fastening and release strength and its resistance to fouling, but in some applications Velcro® fastener might be used. In the illustrated embodiment, ski-side fastener portion 12*a* comprises two spaced, lengthwise strips extending over at least a central boot-supporting region 11*a* of the ski (whose location will vary from ski to ski, depending on desired performance characteristics, boot size and spacing, and other features understood by those skilled in the art). It is possible to use a single wide strip or block of material 12*a,* although two spaced strips are preferred for strength, stability, control and release characteristics.

The force needed to shear or pull plate 14 and boots 16 from ski 10 can be adjusted by reducing or increasing the surface area of fastener material 12 on the ski and/or plate. One simple way to do this is to simply cover a portion of the ski-side material 12*a* or bootside material 12*b* with one or more mating strips before fastening the plate to the ski, thereby reducing the mating surface area between the plate and ski.

Figure 2:
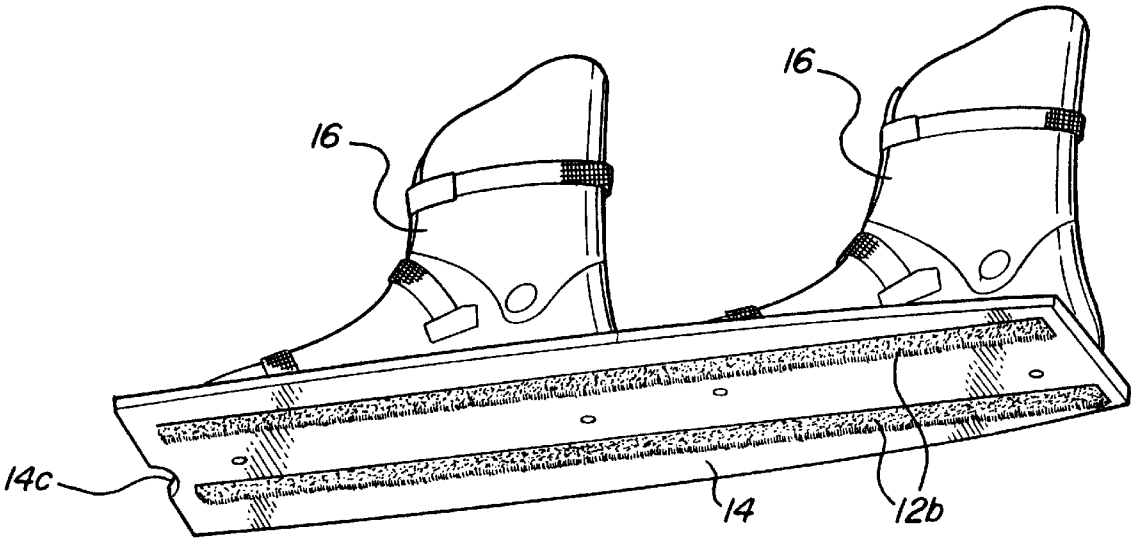
FIG. 2 is a perspective view of the underside of the boot-side of the binding system of FIG. 1.
Figure 3:
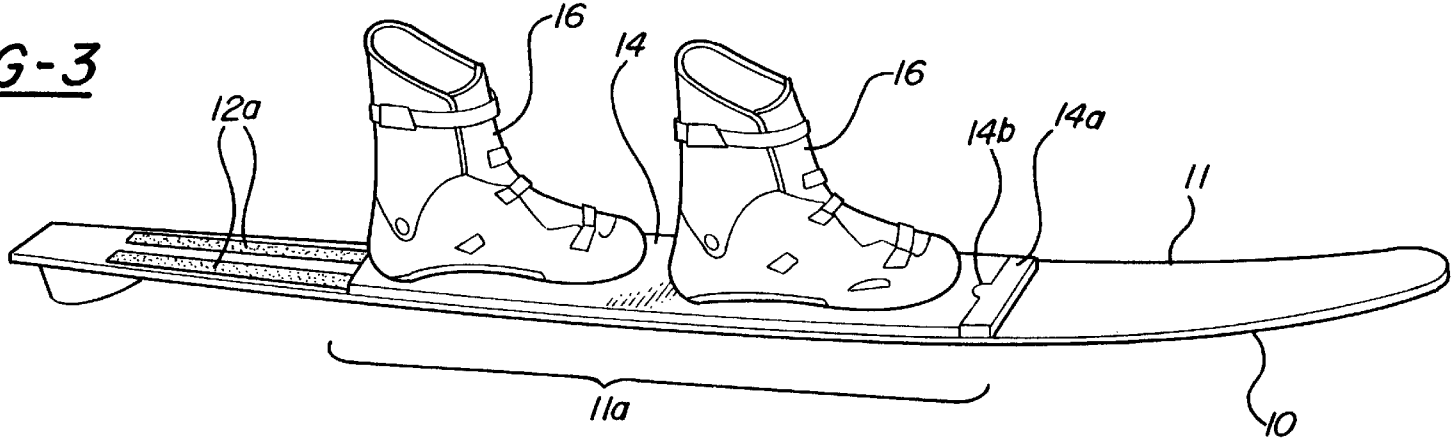
FIG. 3 is a perspective view of the assembled ski, binding system, and boots of FIG. 1.

FIG. 1 shows the upwardly facing ski-side portion 12*a* of fastener 12. Mating material 12*b* is illustrated on the underside of plate 14 in FIG. 2, and as will be understood by those skilled in the art, it will be identical in composition to ski-side material 12*a* in the case of Dual-Lock® fasteners, or will comprise the complementary hook or loop portion of the two-part Velcro® brand fastener material. Of course, the fastener portions 12*b* on the underside of plate 14 will be of a length, location and spacing to mate with the arrangement of fastener material 12*a* on the upper surface of ski 10. Strips 12 on the underside of plate 12*a* are preferably fastened to the plate with a strong, permanent adhesive, although other means may be employed. It is preferred that fastener strips 12 on the ski are applied by a non-invasive process such as adhesive or chemical or thermal bonding which will not affect the internal structure, and therefore the performance, of the ski itself.

As illustrated, the present invention connects two boots 16 (forward and rear) on a single mounting plate 14, such that both boots, and hence both feet of the skier, are attached to the ski as a monolithic unit. This offers several advantages, including but not limited to enhanced control over the ski, faster mounting of the boots to the ski, simultaneous release of both feet from the ski in the event of a fall, and repeatable relative foot position.

In the illustrated embodiment, binding plate 14 is formed from a lightweight fiber/resin composite material, similar to that used in the water ski, although other materials such as aluminum or steel are possible. Binding plate is at least rigid enough that the boots tear off the ski together, as a unit. However, the illustrated composite plate 14 has some inherent flex, as will be recognized by those skilled in the art, preferably similar to the flex characteristics of the water ski.

While the structure joining the boots as a unit to the ski is shown and described as a "plate", it will be understood that it need not literally be a separate rectangular plate as shown. The ski is preferably provided with a locator piece 14*a* shaped to mate with the toe-end 14*b* on plate 14. In the illustrated embodiment locator 14*a* is a small rectangular piece with a rounded projection facing a mating rounded cutout in toe end 14*b* of plate 14. Locator 14 serves to both position plate 14 (and therefore boots 16) longitudinally on the ski in a preferred location, and further to align plate 14, boots 16 and therefore the skier's feet on the ski in a repeatable fashion. In a further preferred form, locator piece 14*a* is secured to the upper surface 11 of ski 10 by Dual Lock® or Velcro® type fastener material, in the same manner as plate 14. In this manner, locator piece 14*a* can be secured in place at different positions along the ski to "customize" the repeatable position of plate 14 on the ski for a particular user. When a different user with different performance needs uses ski 10, he can simply re-position locator piece 14*a* against the toe end of plate 14 when the best position has been established. Thereafter, when plate 14 and boots 16 are released from the ski during a fall, locator piece 14*a* will remain in place on the ski to provide a re-positioning marker.

Locator piece 14*a* is preferably formed from the same material as plate 14, and may be cut from plate 14.

Another feature of the invention is the at least semi-rigid nature of boots 16, which in the illustrated embodiment comprise modified in-line skating boots with a partial rigid plastic shell which provides lateral stiffness and limited fore and aft flex. Such boots are available, for example, from the Bauer Company, known for its skating-type boots. The provision of at least semi-rigid boots on a single, monolithic binding plate fastened releasably and non-invasively to the upper surface of the ski provides superior control over the ski (whose inherent performance characteristics are not affected), improved release of the skier's feet in a fall, and simplified re-mounting of the boot-plate assembly 14, 16 to the ski.

Figure 4:
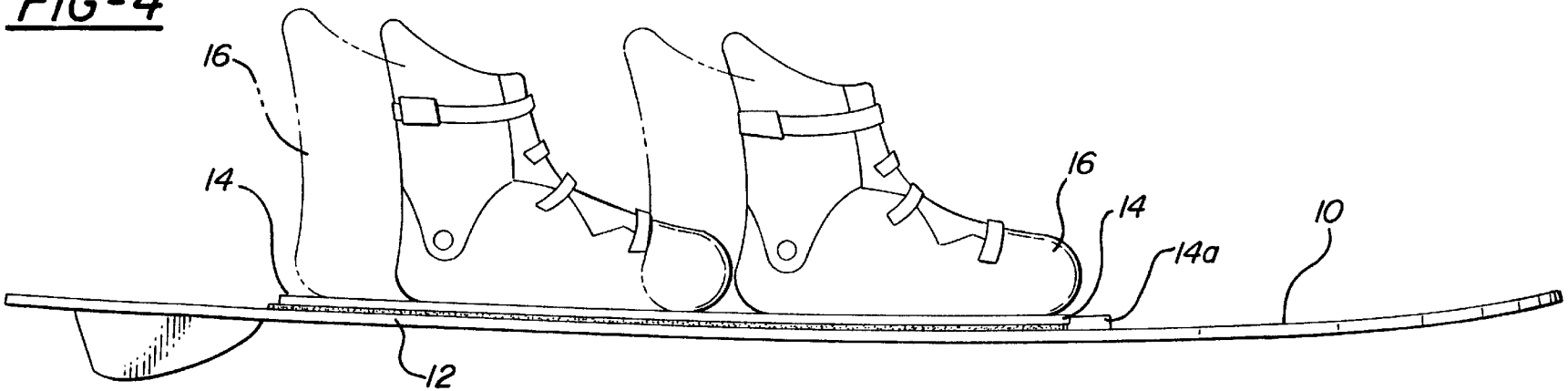
FIG. 4 is a side elevation view of the binding system of FIG. 1 with lengthwise boot position adjustments shown in phantom.

Additionally, by extending the length of fastener strips 12*a* along the upper surface 11 of ski 10, schematically illustrated in FIG. 1 running along a major portion of the ski beyond the immediate region 11*a* of the boots, the skier has the ability to custom-adjust the location of the boots on the ski by merely tearing plate 14 off and repositioning it either forward or aft on the ski. This adjustment ability is best shown in FIG. 4 in schematic fashion. Skiers will recognize the benefits in this adjustability feature.

Figure 5:
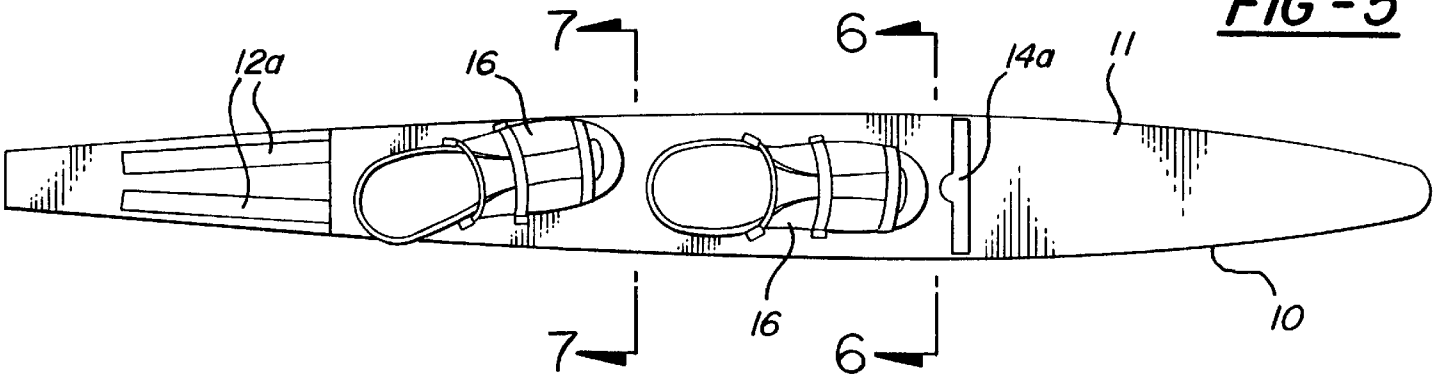
FIG. 5 is a plan view of the assembled ski, binding system and boots of FIG. 1, illustrating a preferred angled mounting of the rear boot on the binding plate.
Figure 7:
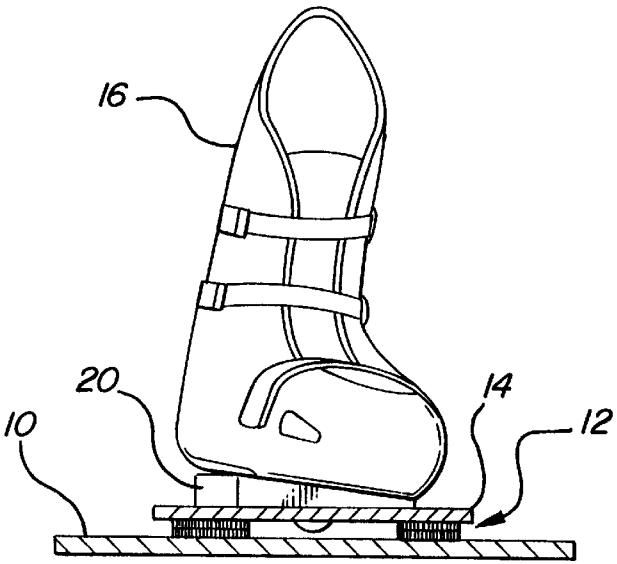
FIGS. 6 and 7 are front end views of the front and rear boots, respectively, of FIG. 5.
Figure 6:
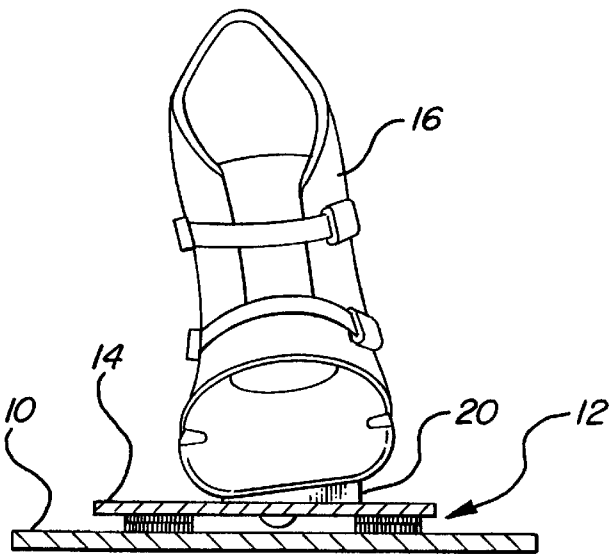

Referring now to FIGS. 5 through 7, two further features of the inventive binding system are illustrated. In the plan view of FIG. 5, it can be seen that rear boot 16 is mounted to plate 14 at an angle relative to the front boot, with a slightly "duck-toed" position. This design accommodates the optimum stance (hips forward, rear foot cocked, rear knee capable of coming straight forward) for slalom-type skiing. Prior art ski boot mounting and binding arrangements have limited the skier to feet-straight-forward positions, which hinder proper leg and knee work on the ski. Because boots 16 are pre-mounted on plate 14 in a non-releasable manner, one or both can be custom-angled and custom-spaced to accommodate the preferences of virtually any skier. Each time the skier locks plate 14 onto the water ski, his pre-set custom foot position is already established.

Another feature of the invention is shown in FIGS. 6 and 7, namely a canted boot-mounting arrangement using angled shims 20 between boot 16 and plate 14. Alternately, a canted sole can be built into boot 16 without a separate shim 20, such that what is shown as separate shim 20 in FIGS. 6 and 7 would simply be pre-molded angled portions of the boots' soles formed in the manufacturing process. Even if initially applied to the plate and boot as a separate piece, each shim 20 is sandwiched between the boot and plate in a non-releasable attachment, effectively becoming an integrated piece of the unitary boot/plate system which releases as a unit from the ski when the skier falls.

While shims 20 in FIGS. 6 and 7 are shown providing a slight outward cant to both the front and rear boots, the cant angle of the shims can be custom-matched to a skier at virtually any side-to-side or front-to-back angle.

Another alternate arrangement for a pre-set cant in the boot and plate binding system is to build the cant angle directly into the plate, with a portion for each boot as desired.

The foregoing description is of an illustrative, preferred embodiment of the invention, and it will be apparent to those skilled in the art (now that I have disclosed my invention) that various modifications may be made without departing from the scope and spirit of the invention as claimed. For example, while my invention is illustrated for a water ski, it can also be provided on similar water sport equipment such as wakeboards. And while the illustrated slalom configuration is preferred (two boots, one ski), it is possible to adapt the boot/plate and Dual Lock® fastener binding system to dual-ski arrangements with a single boot per ski.

Accordingly, I claim:

1. A releasable water ski boot binding system for a water ski, comprising:

fore and aft boots connected to a sole plate as a single boot/plate unit in which the boots are non-releasably attached to the plate and are designed to non-releasably hold the feet of the skier;

hook and loop-type fastener means fastened to an underside of the sole plate; and hook and loop-type fastener means fastened to an upper surface of a water ski, such that the boot/plate unit can be releasably secured to the water ski via the hook and loop-type fastener means, wherein the boot/plate unit is adapted to remain secured to the water ski during normal skiing and the boot/plate unit is adapted to be released from the water ski when intentionally removed or in the event of a fall.

2. The apparatus of claim 1, wherein the boots are at least semi-rigid and provide lateral support and fore and aft flexibility.

3. The apparatus of claim 1, wherein the hook and loop-type fastener means comprises two spaced, longitudinally oriented strips on the ski, and two spaced, longitudinally oriented strips on the underside of the plate.

4. The apparatus of claim 1, wherein the hook and loop fastener means on the upper surface of the water ski has a length greater than the length of the hook and loop fastener means on the undersurface of the boot/plate unit, such that the boot plate unit can be releasably mounted at different locations along the length of the ski.

5. The apparatus of claim 1, wherein at least one of the boots is non-releasably mounted on the plate at an angle relative to the longitudinal axis of the ski to accommodate a skier's preferred foot orientation.

6. The apparatus of claim 1, wherein at least one of the boots is non-releasably mounted on the plate at a cant angle to accommodate a skier's foot pronation.

7. The apparatus of claim 1, further including a locator piece mounted on the upper surface of the ski adjacent a toe end of the plate to mate with at least a portion of the toe end of the plate to properly locate the boot/plate unit on the ski.

8. The apparatus of claim 7, wherein the locator piece is releasably attached to the upper surface of the ski so that it can be mounted in different locations to customize the properly located position of the boot/plate unit.

9. A releasable water ski boot binding system for a water ski comprising:

fore and aft boots connected to a sole plate as a single boot/plate unit in which the boots are non-releasably attached to the plate;

hook and loop-type fastener means fastened to an underside of the sole plate;

hook and loop-type fastener means fastened to an upper surface of the water ski, such that the boot/plate unit can be releasably secured to the water ski via the hook and loop-type fasteners; and wherein at least one of the boots is non-releasably mounted on the plate at an angle relative to the longitudinal axis of the ski to accommodate a skier's preferred foot position.

10. The apparatus of claim 9 wherein at least one boot is non-releasably mounted on the plate at a cant angle to accommodate a skier's foot position.

11. A releasable water ski boot binding system for a water ski comprising:

fore and aft boots connected to a sole plate as a single boot/plate unit in which the boots are non-releasably attached to the plate;

hook and loop-type fastener means fastened to an underside of the sole plate;

hook and loop-type fastener means fastened to an upper surface of the water ski, such that the boot/plate unit can be releasably secured to the water ski via the hook and loop-type fasteners; and a locator piece mounted on the upper surface of the ski adjacent a toe end of the plate to mate with at least a portion of the toe end of the plate to properly locate the boot/plate unit on the ski.

12. The apparatus of claim 11 wherein the locator piece is releasably attached to the upper surface of the ski so that it can be mounted in different locations to customize the properly located position of the boot/plate unit.

* * * * *